US010049833B2

(12) United States Patent
Tachikawa

(10) Patent No.: US 10,049,833 B2
(45) Date of Patent: Aug. 14, 2018

(54) INPUT DEVICE, ELECTRONIC EQUIPMENT, AND METHOD OF MANUFACTURING THE INPUT DEVICE

(71) Applicant: FUJITSU LIMITED, Kawasaki-shi, Kanagawa (JP)

(72) Inventor: Hideaki Tachikawa, Inagi (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/287,159

(22) Filed: Oct. 6, 2016

(65) Prior Publication Data

US 2017/0110268 A1 Apr. 20, 2017

(30) Foreign Application Priority Data

Oct. 14, 2015 (JP) ..... 2015-202727

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/70*** | (2006.01) |
| ***H01H 13/88*** | (2006.01) |

(52) U.S. Cl.

CPC ..... *H01H 13/70* (2013.01); *H01H 13/88* (2013.01); *H01H 2223/056* (2013.01)

(58) Field of Classification Search

CPC ... H01H 13/70; H01H 13/88; H01H 2223/056
See application file for complete search history.

(56) References Cited

U.S. PATENT DOCUMENTS

| | | | | |
|---|---|---|---|---|
| 5,969,644 | A * | 10/1999 | Koutaka | H01H 13/702 200/5 A |
| 2013/0250509 | A1 | 9/2013 | Tachikawa et al. | |
| 2013/0308261 | A1 | 11/2013 | Matsumoto et al. | |
| 2016/0224078 | A1* | 8/2016 | Chen | G06F 1/1632 |

FOREIGN PATENT DOCUMENTS

| | | | |
|---|---|---|---|
| JP | 2009-294809 | A | 12/2009 |
| JP | 2013-122729 | A | 6/2013 |
| JP | 2013-200677 | A | 10/2013 |
| JP | 2013-242729 | A | 12/2013 |
| JP | 2014-153979 | A | 8/2014 |

* cited by examiner

*Primary Examiner* — Edwin A. Leon
*Assistant Examiner* — Lheiren Mae A Caroc
(74) *Attorney, Agent, or Firm* — Westerman, Hattori, Daniels & Adrian, LLP

(57) ABSTRACT

An input device includes an upper cover including a plurality of key openings and a keyboard including a base plate disposed on a back side of the upper cover, and a plurality of key tops provided in a front side of the base plate and inserted in the respective key openings. A plurality of hooks, each of which is disposed between the key tops adjacent to each other at a plurality of points and is provided upright on a back surface of the upper cover, fixes the keyboard to the upper cover.

13 Claims, 19 Drawing Sheets

INPUT DEVICE, ELECTRONIC EQUIPMENT, AND METHOD OF MANUFACTURING THE INPUT DEVICE

CROSS-REFERENCE TO RELATED APPLICATION

This application is based upon and claims the benefit of priority of the prior Japanese Patent Application No. 2015-202727, filed on Oct. 14, 2015, the entire contents of which are incorporated herein by reference.

FIELD

The embodiments discussed herein are related to an input device, an electronic equipment, and a method of manufacturing the input device.

BACKGROUND

For instance, a notebook personal computer includes a display device and a main device. In general, the main device is provided with an upper cover and an input device having a keyboard. Also, in some of this type of input device, the keyboard is assembled to the upper cover from the back side of the upper cover. In such an input device, a plurality of key openings is formed in the upper cover, and a plurality of key tops provided in the keyboard is inserted in the respective key openings from the back side of the upper cover and is exposed to the front side of the upper cover (see, for instance, Japanese Laid-open Patent Publication No. 2013-200677).

Related techniques are disclosed in, for example, Japanese Laid-open Patent Publication Nos. 2009-294809, 2013-122729, and 2013-242729.

In the above-mentioned input device, if depression of a key top occurs when the key top is pressed, the perceived quality of the input device may be reduced. Therefore, in order to improve the perceived quality of the input device, it is preferable to reduce depression of each key top when pressed. Here, the "depression" means causing a gap or space between the keyboard and the upper cover due to a bend of the keyboard base when a key is pressed.

Also, in an input device in which the keyboard is assembled to the upper cover from the back side of the upper cover, an approach may be taken in which the keyboard is bonded to the upper cover. However, in the case where the keyboard is bonded to the back surface of the upper cover, it may become difficult to separate the keyboard from the upper cover when the input device is disassembled.

Thus, in an input device in which the keyboard is assembled to the upper cover from the back side of the upper cover, an approach may be taken in which the keyboard is fixed to the upper cover by screws. However, in the case where the keyboard is fixed to the upper cover by screws, a large number of screws has to be used, and man-hours for assembly and disassembly of the input device is increased.

As an aspect, the technique disclosed in the present application aims to decrease the man-hours for assembly and disassembly of the input device while reducing depression of each key top when pressed.

SUMMARY

According to an aspect of the invention, an input device includes an upper cover including a plurality of key openings and a keyboard including a base plate disposed on a back side of the upper cover, and a plurality of key tops provided in a front side of the base plate and inserted in the respective key openings. A plurality of hooks, each of which is disposed between the key tops adjacent to each other at a plurality of points and is provided upright on a back surface of the upper cover, fixes the keyboard to the upper cover.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

[First Embodiment]

First, a first embodiment of the technique disclosed in the present application will be described.

Figure 1:
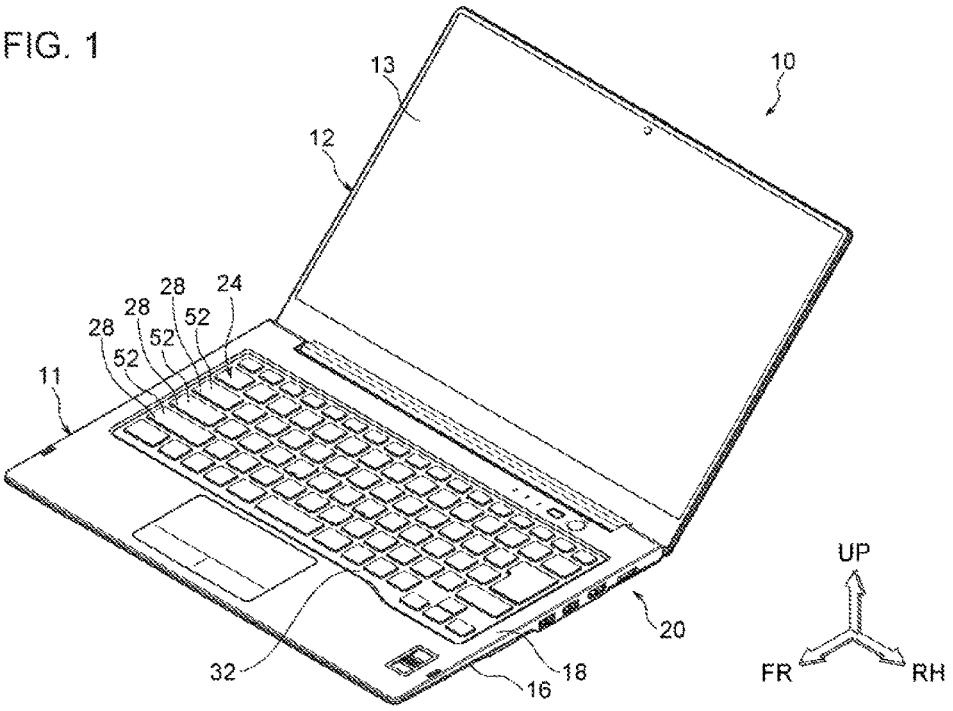
FIG. 1 is a perspective view of a notebook personal computer.

In the first embodiment, a notebook personal computer will be described as an example of the "electronic equipment". In FIG. 1, a notebook personal computer 10 according to the first embodiment is illustrated as a perspective view.

In each figure, UP arrow, FR arrow, and RH arrow indicate the upper side in the height direction, the near side (the front side) in the depth direction, and the right side in the breadth direction of the notebook personal computer 10, respectively. As illustrated in FIG. 1, the notebook personal computer 10 includes a main device 11 and a display device 12.

The display device 12 is provided with, for instance, a display instrument 13 such as a liquid crystal display instrument. The display device 12 is rotatably fixed to the main device 11. The display device 12 assumes a state of being closed to the main device 11 side and a state of being open from the main device 11. In FIG. 1, the display device 12 is illustrated in an open state.

The main device 11 has a lower cover 16 and an upper cover 18. The lower cover 16 and the upper cover 18 are divided in a thickness direction of the main device 11 formed in a flat plate shape. The later-described input device 20 including a keyboard 24 is provided on the side of the upper cover 18 out of the lower cover 16 and the upper cover 18.

Figure 2:
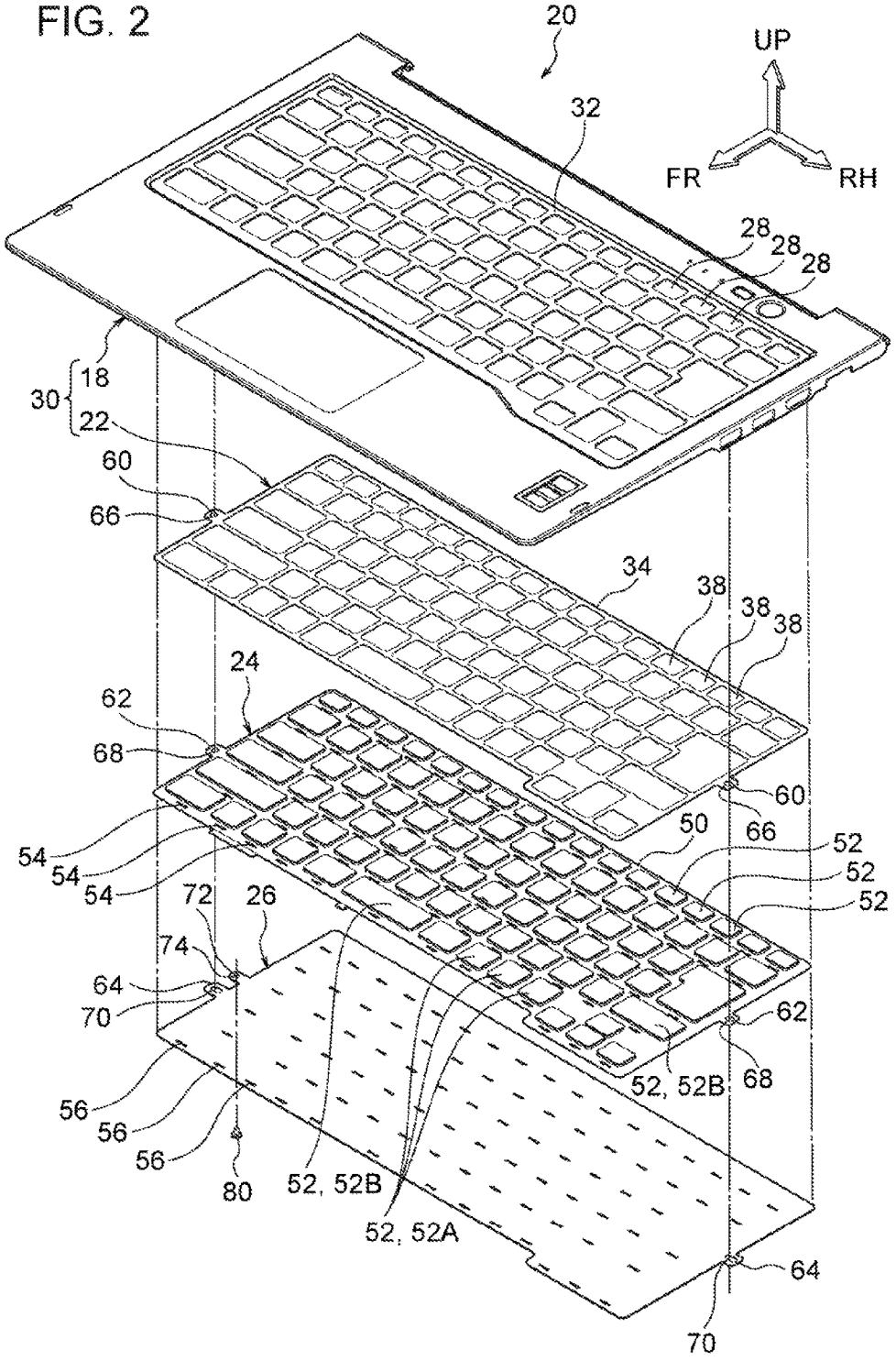
FIG. 2 is an exploded perspective view of an input device in a first embodiment as seen from the front side.
Figure 3:
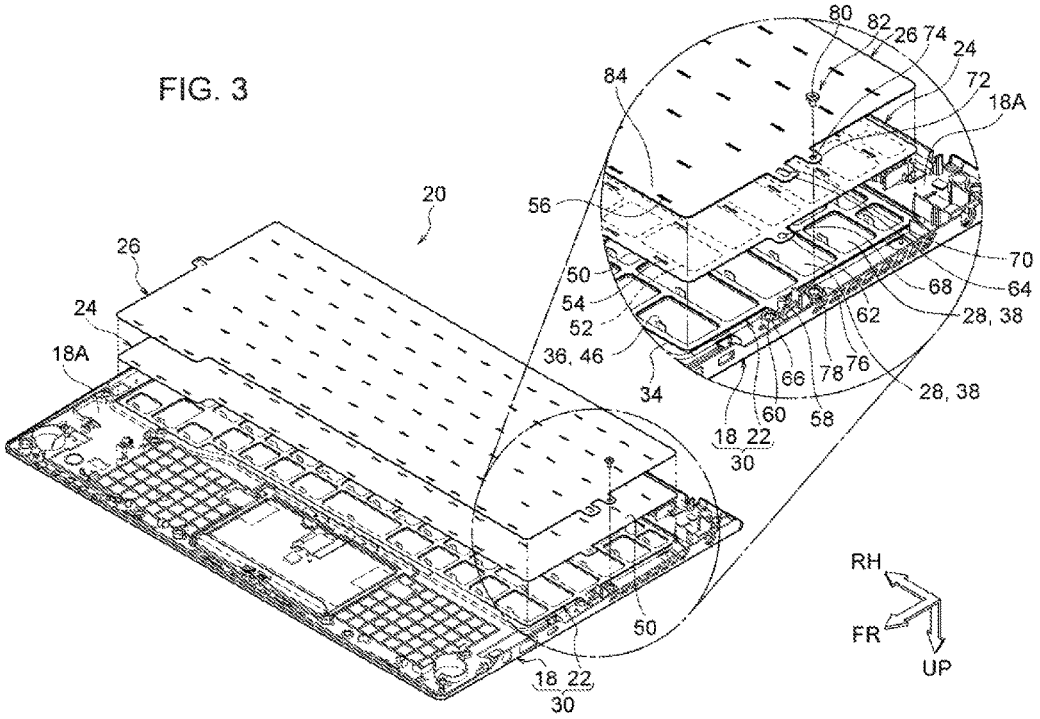
FIG. 3 is an exploded perspective view of the input device in the first embodiment as seen from the back side.
Figure 4:
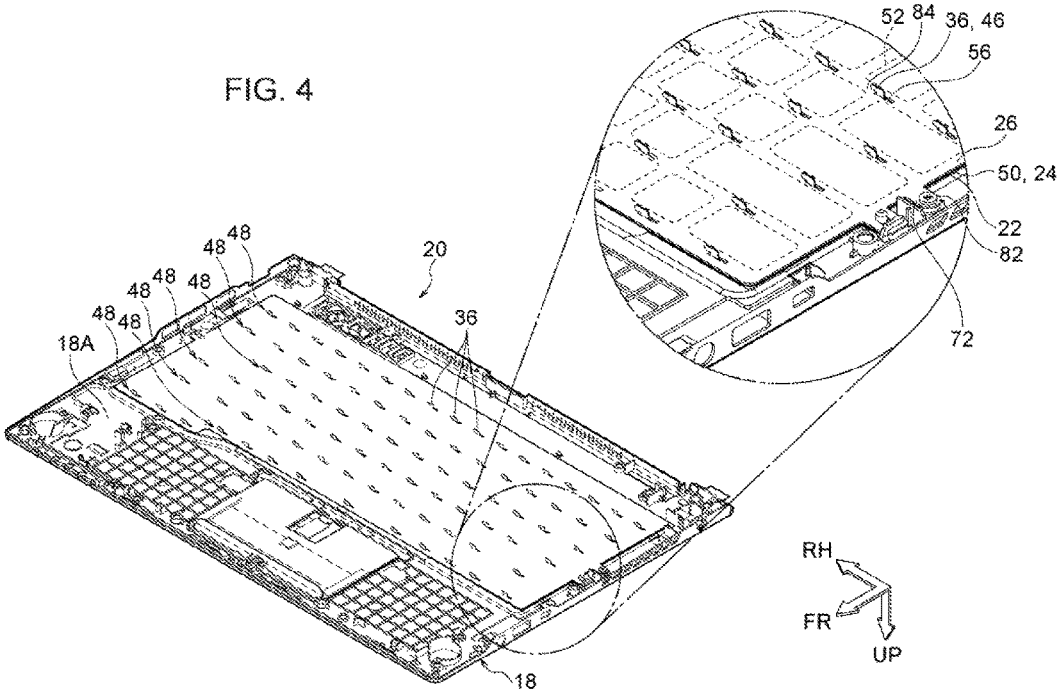
FIG. 4 is a perspective view illustrating a state of the input device in the first embodiment after being assembled.

In FIGS. 2 to 4, an input device 20 according to the first embodiment is illustrated. As illustrated in FIG. 2, FIG. 3, the input device 20 includes the upper cover 18, a mounting member 22, a keyboard 24, and a support plate 26 (see also FIG. 4 as appropriate).

The upper cover 18 has a plurality of key openings 28. The key opening 28 are formed correspondingly to a plurality of respective key tops 52 provided in the keyboard 24, and are arranged in the depth direction and the breadth direction of the upper cover 18. The key openings 28 are through in the thickness direction of the upper cover 18.

Each of the key openings 28 is formed in a similar shape to the outside shape of a key top 52 corresponding to the key opening 28. Each key opening 28 is formed slightly larger than the outside shape of the key top 52 so as to have a clearance with the key top 52 as small as possible.

Figure 5:
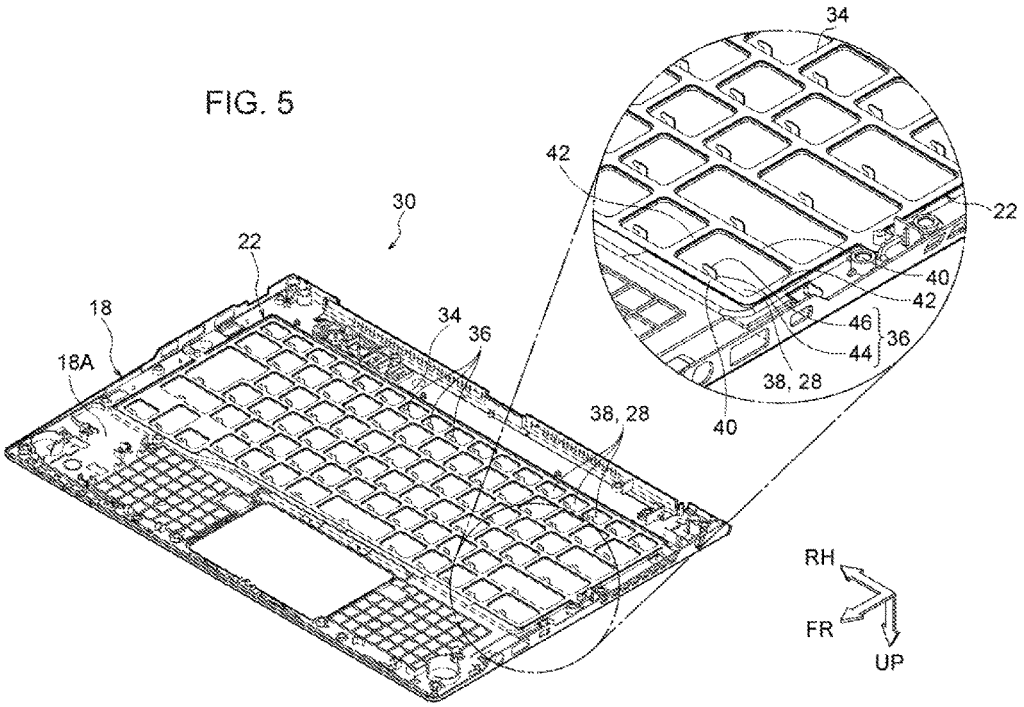
FIG. 5 is a perspective view of an upper cover structure in the first embodiment as seen from the back side.

The mounting member 22 is formed in a thin plate frame shape, and is stacked on a back surface 18A of the upper cover 18 (see FIG. 3, FIG. 4). The mounting member 22 along with the upper cover 18 forms an upper cover structure 30. In FIG. 5, the upper cover structure 30 is illustrated as a perspective view. FIG. 5 illustrates a state where the mounting member 22 is stacked on the back surface 18A of the upper cover 18. The mounting member 22 is fixed to the back surface 18A of the upper cover 18, for instance, by bonding or welding.

The outside shape of the mounting member 22 is formed in shape and size corresponding to those of a key top arrangement area 32 (area in which the key openings 28 are formed and which is slightly depressed with respect to the surrounding) of the upper cover 18 illustrated in FIG. 2. The mounting member 22 is formed in a substantially rectangular shape in a plan view with a longitudinal direction in the breadth direction of the upper cover 18 and a transverse direction in the depth direction of the upper cover 18.

More specifically, the mounting member 22 has a frame portion 34 formed in a frame shape, and a plurality of hooks 36. The frame portion 34 has a plurality of matching holes 38, each of which matches a corresponding one of the key openings 28. The matching holes 38 are each formed in a similar shape to a corresponding one of the key openings 28, and are through in a plate thickness direction of the mounting member 22. In the frame portion 34 formed in a frame shape having the matching holes 38, a pair of length edges 40 extending in the longitudinal direction of the mounting member 22, and a pair of width edges 42 extending in the transverse direction of the mounting member 22 are formed in the surrounding of each matching hole 38.

The hooks 36 are provided upright in the respective edges of the matching holes 38. More specifically, each of the hooks 36 is formed in one of the pair of length edges 40 positioned on both sides of each matching hole 38, the one being positioned on the front side (the FR arrow side) of the upper cover 18 with respect to the matching hole 38. Each hook 36 is formed in a central portion of the one length edge 40 in the longitudinal direction.

Also, when let the upper cover 18 side of the mounting member 22 be the front side of the mounting member 22, and the opposite side of the upper cover 18 be the back side of the mounting member 22, the hooks 36 extend to the back side of the mounting member 22. As illustrated in FIG. 5, in a state where the mounting member 22 is attached to the back surface 18A of the upper cover 18, the hooks 36 are provided upright on the back surface 18A of the upper cover 18.

Figure 6:
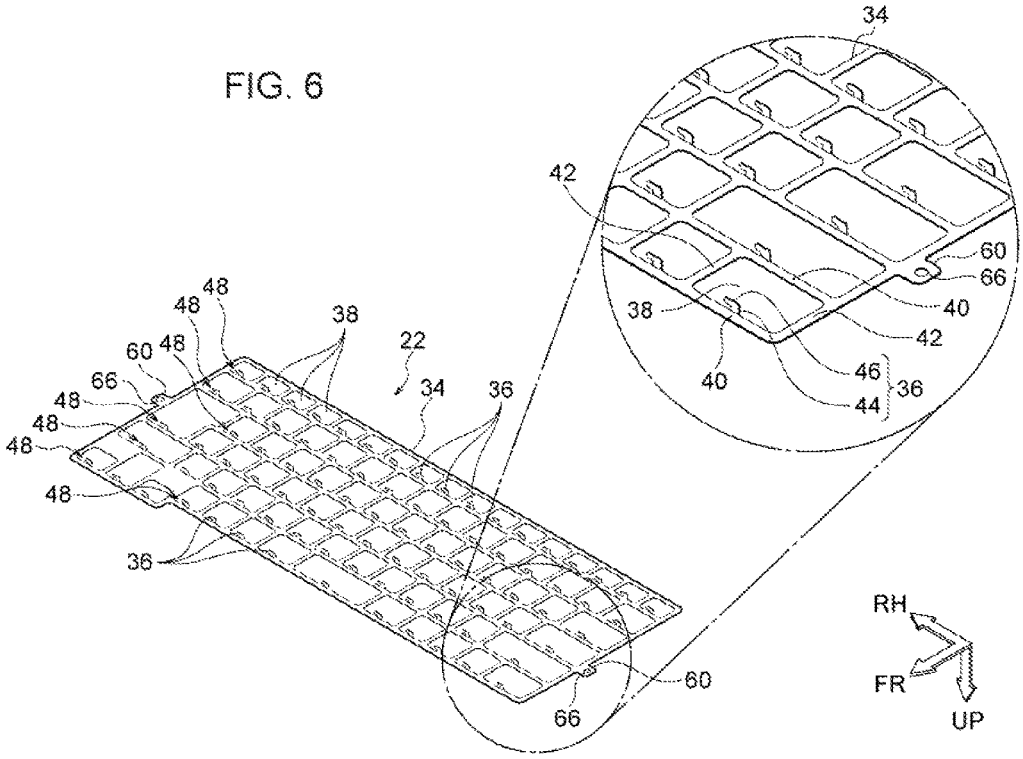
FIG. 6 is a perspective view of a mounting member in the first embodiment as seen from the back side.
Figure 7:
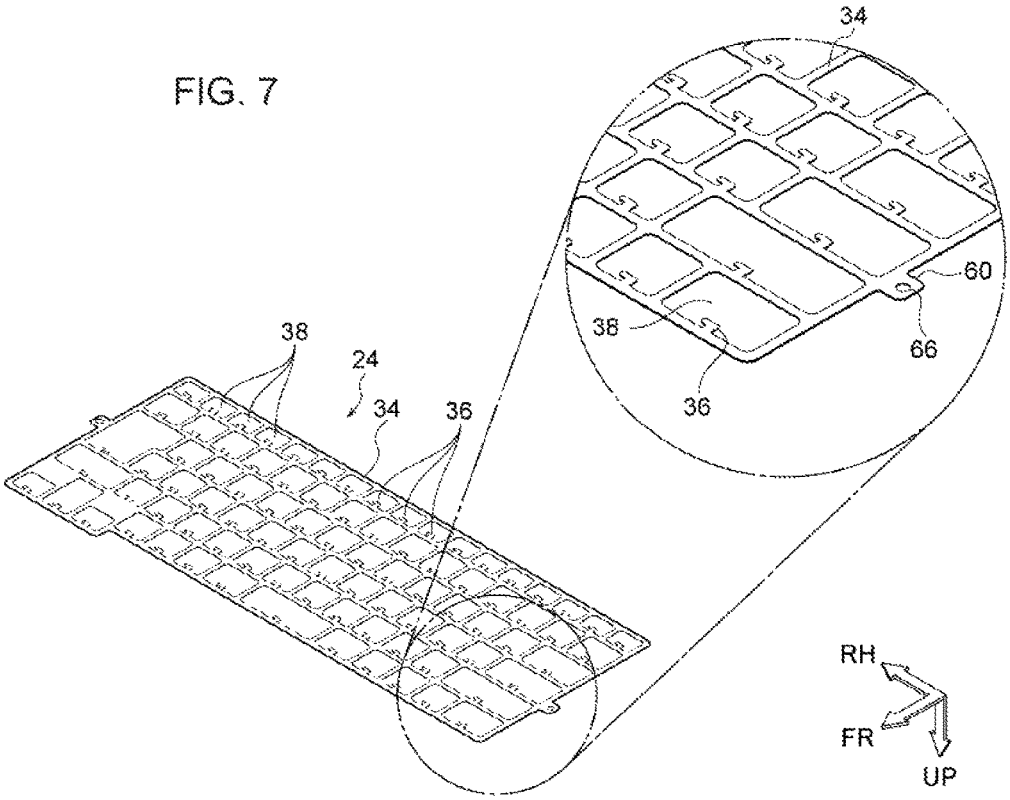
FIG. 7 is a perspective view illustrating a state of the mounting member in the first embodiment before being bent.

In FIG. 6, FIG. 7, the mounting member 22 is illustrated as a single body. The mounting member 22 is made of metal as an example, and is formed by punching and bending. FIG. 6 illustrates a state of the mounting member 22 which is punched then bent. FIG. 7 illustrates a state of the mounting member 22 which is punched but before bending.

As illustrated in FIG. 7, the hooks 36 and the matching holes 38 are formed by punching. The hooks 36, before a state of being bent, are in a state of lying in the transverse direction of the mounting member 22. As illustrated in FIG. 6, the hooks 36 are bent, thereby assuming a state of standing upright on the back side of the mounting member 22. Each hook 36 is formed in a substantially L-character shape having a base 44 extending to the back side of the mounting member 22, and a leading end 46 extending from the leading end of the base 44 to one side (the RH arrow side) of the mounting member 22 in the longitudinal direction.

In addition, the hooks 36 form a plurality of hook sequences 48. Each of the hook sequences 48 is linearly formed by multiple hooks 36 that are arranged in the longitudinal direction of the mounting member 22. The hook sequences 48 are arranged in the transverse direction of the mounting member 22.

As illustrated in FIG. 2, the keyboard 24 has a base plate 50 and the key tops 52. The base plate 50 is disposed on the back side (back side of the mounting member 22) of the upper cover 18. The keyboard 24 (base plate 50) is formed in a shape having a longitudinal direction and a transverse direction in a plan view, for instance, a substantially rectangular shape.

The keyboard 24 is disposed with its longitudinal direction in the breadth direction of the upper cover 18. The base plate 50, the key top arrangement area 32 in the upper cover 18, the mounting member 22, and the later-described support plate 26 are formed in substantially the same outside shape and size.

As illustrated in FIG. 3, FIG. 4, a plurality of first through holes 54 through in a plate thickness direction of the base plate 50 is formed in the base plate 50, which is preferably made of metal. The first through holes 54 are formed at respective positions corresponding to the above-described hooks 36. Each first through hole 54 is formed in a rectangular shape in a plan view extending in the longitudinal direction of the base plate 50, and is formed in a size that allows the leading end 46 of each hook 35 to pass through.

As illustrated in FIG. 2, the key tops 52 are provided on the front side of the base plate 50. The key tops 52 are arranged in the longitudinal direction and the transverse direction of the base plate 50. In a state where the base plate 50 is assembled to the back, side of the upper cover 18, the key tops 52 are inserted in the corresponding key openings 28 through the matching holes 38, and are exposed to the front side of the upper cover 18. Like this, the keyboard 24 is formed as an isolation keyboard in which only the key tops 52 are exposed through the key openings 28 formed in the upper cover 18.

The key tops 52 include rectangular key tops 52B in a plan view, such as a shift key or a space key in addition to square key tops 52A in a plan view, such as an alphabetic key. The rectangular key tops 52B are arranged with its longitudinal direction in the longitudinal direction (the breadth direction) of the keyboard 24.

As illustrated in FIG. 3, the support plate 26, which is also made of metal, is disposed on the back side (the back side of the base plate 50) of the keyboard 24. The support plate 26 is formed in a substantially rectangular shape in a plan view with its longitudinal direction and transverse direction in the longitudinal direction (the breadth direction) and the transverse direction (the depth direction) respectively of the keyboard 24.

In the support plate 26, a plurality of second through holes 56 through in a plate thickness direction of the support plate 26 is formed. The second through holes 56 are formed at respective positions corresponding to the above-described hooks 36 and first through holes 54. Similarly to the first through holes 54, each of the second through holes 56 is formed in a rectangular shape in a plan view extending in the longitudinal direction of the support plate 26, and is formed in a size that allows the leading end 46 of each hook 36 to pass through.

As illustrated in FIG. 3, a positioning pin 58 is formed in the back surface 18A of the upper cover 18. The positioning pin 58 is provided in each of lateral portions on both sides of the back surface 18A of the upper cover 18 in the breadth direction.

On the other hand, a first positioning piece 60 is formed in each of the longitudinal both ends of the mounting member 22, a second positioning piece 62 is formed in each of the longitudinal both ends of the base plate 50, and a third positioning piece 64 is formed in each of the longitudinal both ends of the support plate 26. The first positioning piece 60, the second positioning piece 62, and the third positioning piece 64 are formed at positions that match with each other. In the first positioning piece 60, the second positioning piece 62, and the third positioning piece 64, respective positioning holes 66, 68, 70 are formed. A positioning pin 58 is inserted in the positioning holes 66, 68, 70.

The positioning hole 66 formed in one of a pair of first positioning pieces 60 formed in longitudinal both ends of the mounting member 22 is a circular hole, and the positioning hole 66 formed in the other first positioning piece 60 is a long hole extending in the longitudinal direction of the mounting member 22 in order to absorb a dimensional error. Similarly, the positioning hole 68 formed in one of a pair of second positioning pieces 62 formed in longitudinal both ends of the keyboard 24 is a circular hole, and the positioning hole 68 formed in the other second positioning piece 62 is a long hole extending in the longitudinal direction of the keyboard 24 in order to absorb a dimensional error. On the other hand, the positioning holes 70 formed in a pair of third positioning pieces 64 formed in longitudinal both ends of the support plate 26 are each a long hole extending in the longitudinal direction of the support plate 26.

In a state where the support plate 26 is assembled to the back side of the base plate 50, the support plate 26 is slidable in the longitudinal direction of the keyboard 24 in a range of relative movement of the positioning pin 58 within the positioning hole 70 which is a long hole. When the support plate 26 slides in the longitudinal direction of the keyboard 24, the base 44 of each hook 36 relatively moves within a corresponding second through hole 56 of the support plate 26 in the longitudinal direction of the support plate 26.

Also, a fixing piece 72 is formed in longitudinal one end of the support plate 26. A fixing hole 74 is formed in the fixing piece 72. On the other hand, in the upper cover 18, a boss section 76 is formed at a position corresponding to the fixing piece 72. In the boss section 76, a screw hole 78, which, communicates with the fixing hole 74, is formed. The fixing piece 72, the boss section 76, and a screw 80 form a fixing section 82 that fixes the support plate 26 to the upper cover 18.

Next, the structure of the input device 20 along with a method of manufacturing (a method of assembling) the input device 20 according to the first embodiment will be described in detail.

As illustrated in FIG. 3, the mounting member 22 is stacked on the back surface 18A of the upper cover 18. The mounting member 22 is then fixed to the back surface 18A of the upper cover 18, for instance, by bonding or welding. In a state where the mounting member 22 is fixed to the back surface 18A of the upper cover 18, the hooks 36 are provided upright on the back surface 18A of the upper cover 18.

Also, when the mounting member 22 is stacked on the back surface 18A of the upper cover 18 as described above, the positioning pin 58 formed in the upper cover 18 is inserted in the positioning hole 66 formed in the first positioning piece 60 of the mounting member 22. The mounting member 22 is then positioned with respect to the upper cover 18. In a state where the mounting member 22 is positioned to the back surface 18A of the upper cover 18, the matching holes 38 match the respective key openings 28.

Subsequently, the base plate 50 of the keyboard 24 is stacked on the mounting member 22 from the back side of the mounting member 22, and the base plate 50 is disposed on the back side of the upper cover 18. When the base plate 50 is disposed on the back side of the upper cover 18, the key tops 52 are inserted in the corresponding key openings 28 through the matching holes 38, and are exposed to the front side of the upper cover 18.

Also, in a state where the upper cover 18, the mounting member 22, and the keyboard 24 are assembled as described above, the hooks 36 are disposed in the respective key tops 52. The hooks 36 are disposed side by side with the corresponding key tops 52 in the depth direction (the transverse direction) of the keyboard 24.

Also, each hook 36 is formed in a central portion of a corresponding length edge 40 in the longitudinal direction, positioned on the front side (FR arrow side) of the upper cover 18 with respect to the matching hole 38. Thus, the hooks 36 are each disposed in a central portion of a key top 52 in the breadth direction and side by side in the longitudinal direction of the key top 52.

Figure 8:
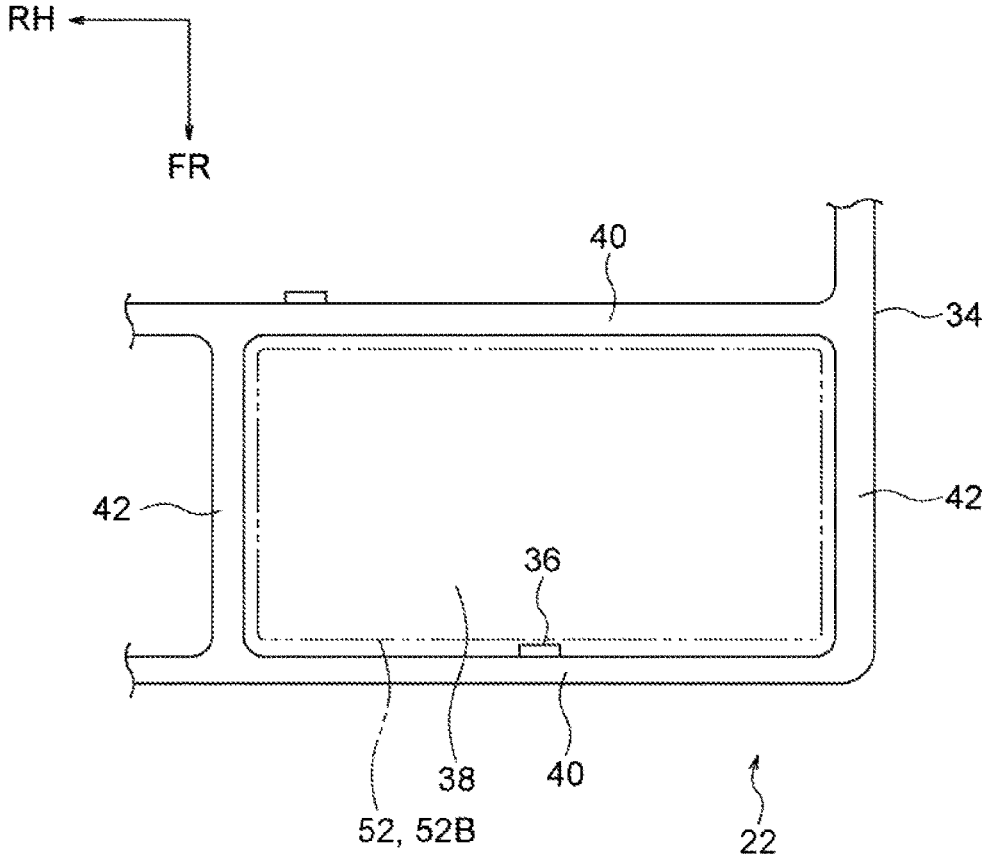
FIG. 8 is a diagram illustrating a positional relationship between a rectangular key top and a hook in the first embodiment.

Here, FIG. 8 illustrates the positional relationship between the rectangular key top 52B and the hook 36. As illustrated in FIG. 8, the key tops 52 include rectangular key tops 52B in a plan view, such as a shift key or a space key, for instance. The hook 36 corresponding to the rectangular key top 52B is disposed in a central portion of the rectangular key top 52B in the longitudinal direction and side by side in the transverse direction of the key tops 52.

Also, when the base plate 50 illustrated in FIG. 3 is disposed on the back side of the upper cover 18 as described above, the positioning pin 58 is inserted in the positioning hole 68 formed in the second positioning piece 62 of the base plate 50, and the base plate 50 is positioned with respect to the upper cover 18. In addition, the hooks 36 formed in the mounting member 22 are inserted in the corresponding first through holes 54 formed in the base plate 50, and the hooks 36 penetrate through the base plate 50.

Subsequently, the support plate 26 is stacked on the back surface of the base plate 50. When the support plate 26 is stacked on the back surface of the base plate 50, the positioning pin 58 is inserted in the positioning hole 70 formed in the third positioning piece 64 of the support plate 26. In addition, the hooks 36 formed in the mounting member 22 and through the base plate 50 are inserted in the corresponding second through holes 56 formed in the support plate 26.

At this point, since the positioning hole 70 formed in the support plate 26 is a long hole extending in the longitudinal direction of the support plate 26, the support plate 26 is slidable in the longitudinal direction of the keyboard 24 in a range of relative movement of the positioning pin 58 within the positioning hole 70.

As illustrated in FIGS. 3 and 4, the support plate 26 is slid in the direction opposite to the extending direction of the leading ends 46 of the hooks 36 (in other words, to the other side in the longitudinal direction of the keyboard 24, and to the opposite side to the RH arrow). When the support plate 26 is slid to the other side of the keyboard 24 in the longitudinal direction in this manner, the leading ends 46 of the hooks 36 are each engaged with the peripheral portion (the engaged portion 84) of a corresponding second through hole 56 in the back surface of the support plate 26.

The screw 80 is then inserted in the fixing hole 74 formed in the fixing piece 72 of the support plate 26 illustrated in FIG. 3 and the leading end 46 of the screw 80 is threaded into the screw hole 78 formed in the boss section 76 of the upper cover 18, and the support plate 26 is fixed to the upper cover 18. The input device 20 is manufactured in the above manner.

It is to be noted that it is possible to disassemble the input device 20 by a procedure reverse to the above procedure. That is, when the screw 80 is removed, the support plate 26 is slidable in the longitudinal direction of the keyboard 24. When the support plate 26 is slid to one side (the RH arrow side) of the keyboard 24 in the longitudinal direction, engagement between the leading ends 46 of the hooks 36 and the support plate 26 (the engaged portion 84) is released, which allows disassembling of the input device 20.

Next, the operation and effect of the first embodiment will be described.

As described in detail above, in the input device 20 according to the first embodiment, the keyboard 24 is assembled to the upper cover 18 from the back side of the upper cover 18. Also, the key openings 28 corresponding to the key tops 52 are formed in the upper cover 18, and the key tops 52 provided in the keyboard 24 are inserted in the corresponding key openings 28 from the back side of the upper cover 18, and are exposed to the front side of the upper cover 18. Therefore, for instance, as in the case where the keyboard 24 is assembled from the front side of the upper cover 18, it is possible to avoid formation of a joint with the outside shape of the keyboard 24 in the upper cover 18. Thus, it is possible to improve the design quality of the input device 20 (the main device 11).

Also, the hooks 36 disposed in the respective key tops 52 are provided upright on the back surface 18A of the upper cover 18, and the keyboard 24 is fixed to the upper cover 18 by the hooks 36. Therefore, it is possible to secure the rigidity of the peripheral portion of each key top 52 in the keyboard 24 by the hooks 36 disposed in the respective key tops 52. Consequently, it is possible to reduce depression of each key top 52 when pressed, and thus the perceived quality of the input device 20 may be improved.

For instance, in a fixed structure in which the keyboard 24 is screwed to the upper cover 18 by a large number of screws, arrangement of a large number of boss sections each having a screw hole is limited. For this reason, it is difficult to dispose a large number of boss sections for the respective key tops 52, and it may not be possible to reduce depression of each key top 52 when pressed. However, the input device 20 according to the first embodiment uses the hooks 36 allowing easy miniaturization, and thus it is possible to dispose the hooks 36 in the respective key tops 52 easily. Consequently, it is possible to support the peripheral portion of each key top 52 in the keyboard 24 by the hooks 36 disposed in the respective key tops 52 while achieving miniaturization.

Also, in the input device 20 according to the first embodiment, the support plate 26 is stacked on the back surface of the base plate 50 of the keyboard 24. The hooks 36 penetrate through the base plate 50, and the leading ends 46 of the hooks 36 are engaged with the support plate 26. Therefore, the support plate 26 allows the base plate 50 of the keyboard 24 to be supported from the back side, thereby making it possible to further effectively reduce depression of each key top 52 when pressed.

Also, the key tops 52 include rectangular key tops 526 in a plan view, such as a shift key or a space key, for instance. The hook 36 corresponding to the rectangular key top 528 is disposed in a central portion of the rectangular key top 528 in a plan view in the longitudinal direction of the length edges 40 corresponding to the key tops 52 (see FIG. 8). Thus, for instance, in contrast to the case where each hook 36 is formed in a width edge 42, the hook 36 is disposed at a position nearer to the central portion of a rectangular key top 52B, and thus it is possible to further effectively reduce depression of the rectangular key top 52B when pressed.

Also, when the input device 20 is assembled, it is sufficient to slide the support plate 26 to the other side of the keyboard 24 in the longitudinal direction to engage the leading ends 46 of the hooks 36 with the support plate 26 and to tighten the screw 80 for fixing the support plate 26 to the upper cover 18. Therefore, for instance, in contrast to a structure in which the keyboard 24 is screwed to the upper cover 18 by a large number of screws, a large number of screws are unnecessary, thereby making it possible to decrease the man-hours for assembly and disassembly of the input device 20.

Also, for instance, in a fixed structure in which the keyboard 24 is bonded to the back surface 18A of the upper cover 18, when the keyboard 24 is released, the keyboard 24 or the upper cover 18 may be deformed or damaged. However, in the input device 20 according to the first embodiment described above, it is possible to disassemble the input device 20 by removing the screw 80 and sliding the support plate 26 to one side of the keyboard 24 in the longitudinal direction to release engagement of the leading ends 46 of the hooks 36 with the support plate 26. Therefore, when the keyboard 24 is released, application of excessive force to the keyboard 24 may be avoided, thereby making it possible to reduce deformation and damage of the keyboard 24 and the upper cover 18. Consequently, reuse of the keyboard 24 and the upper cover 18 is possible.

Also, the support plate 26 is slidable in the longitudinal direction of the keyboard 24, and sliding the support plate 26 allows switching between engagement and disengagement of the hooks 36 with the support plate 26 (the engaged portion 84). Consequently, assembly and disassembly of the input device 20 may be made more easily.

Also, in the hooks 36, a plurality of hook sequences 48, in each of which multiple hooks 36 are arranged in the longitudinal direction of the keyboard 24, is formed in the transverse direction of the keyboard 24. Therefore, for instance, compared with the case where the hooks 36 are arranged in a staggered or random manner, it is possible to ensure the accuracy of arrangement of the hooks 36. Thus, it is possible to smoothly insert and remove the hooks 36 in and from the first through holes 54 of the base plate 50 and the second through holes 56 of the support plate 26, thereby enabling assembly and disassembly of the input device 20 more easily.

Also, for instance, in the case where the keyboard 24 has to be slid when the keyboard 24 is assembled to the upper cover 18, a clearance corresponding to the degree of the sliding has to be provided between each key top 52 and the inner face of a key opening 28. However, the input device 20 according to the first embodiment described above allows the input device 20 to be assembled and disassembled by sliding the support plate 26 not the keyboard 24. Thus, the space between the key top 52 and the inner face of the key opening 28 may be reduced, thereby making it possible to further improve the design quality of the input device 20 (the main device 11).

Next, a modification of the first embodiment will be described.

Although the input device 20 is applied to the main device 11 of the notebook personal computer 10 in the first embodiment described above, the input device 20 may be applied to an electronic equipment other than the main device of a notebook personal computer.

Although an electronic equipment to which the input device 20 is applied is a notebook personal computer, alternatively, the electronic equipment may be other than a notebook personal computer.

Figure 16:
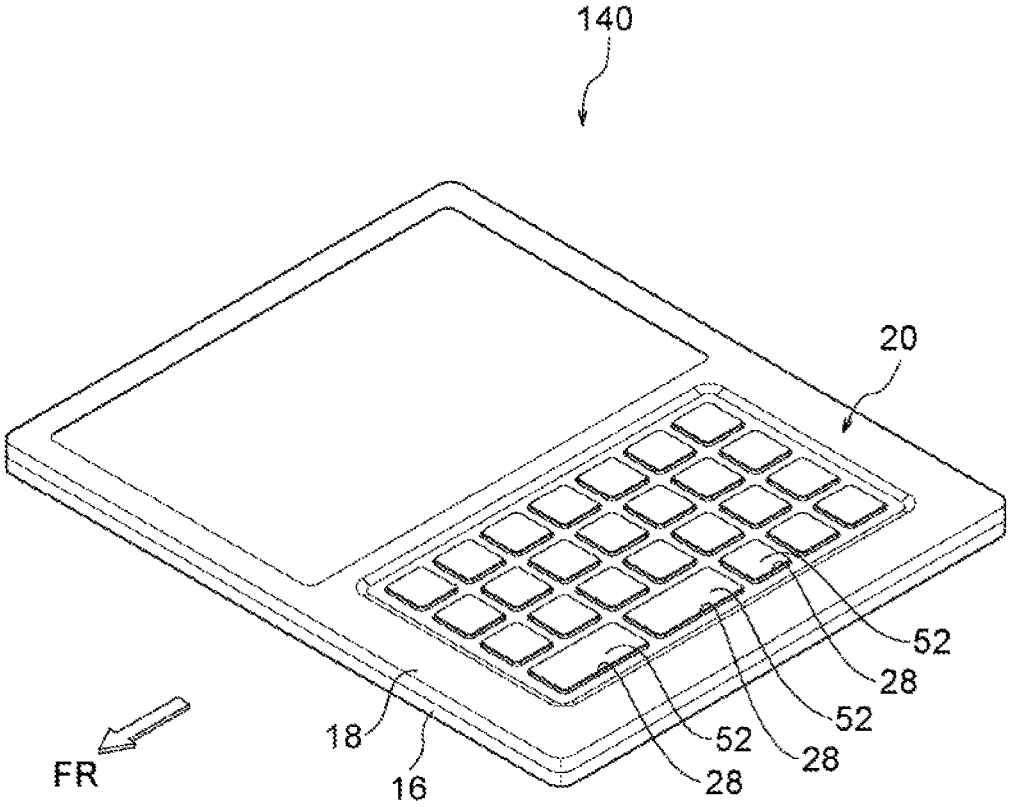
FIG. 16 is a perspective view of an electronic equipment according to a first modification.
Figure 17:
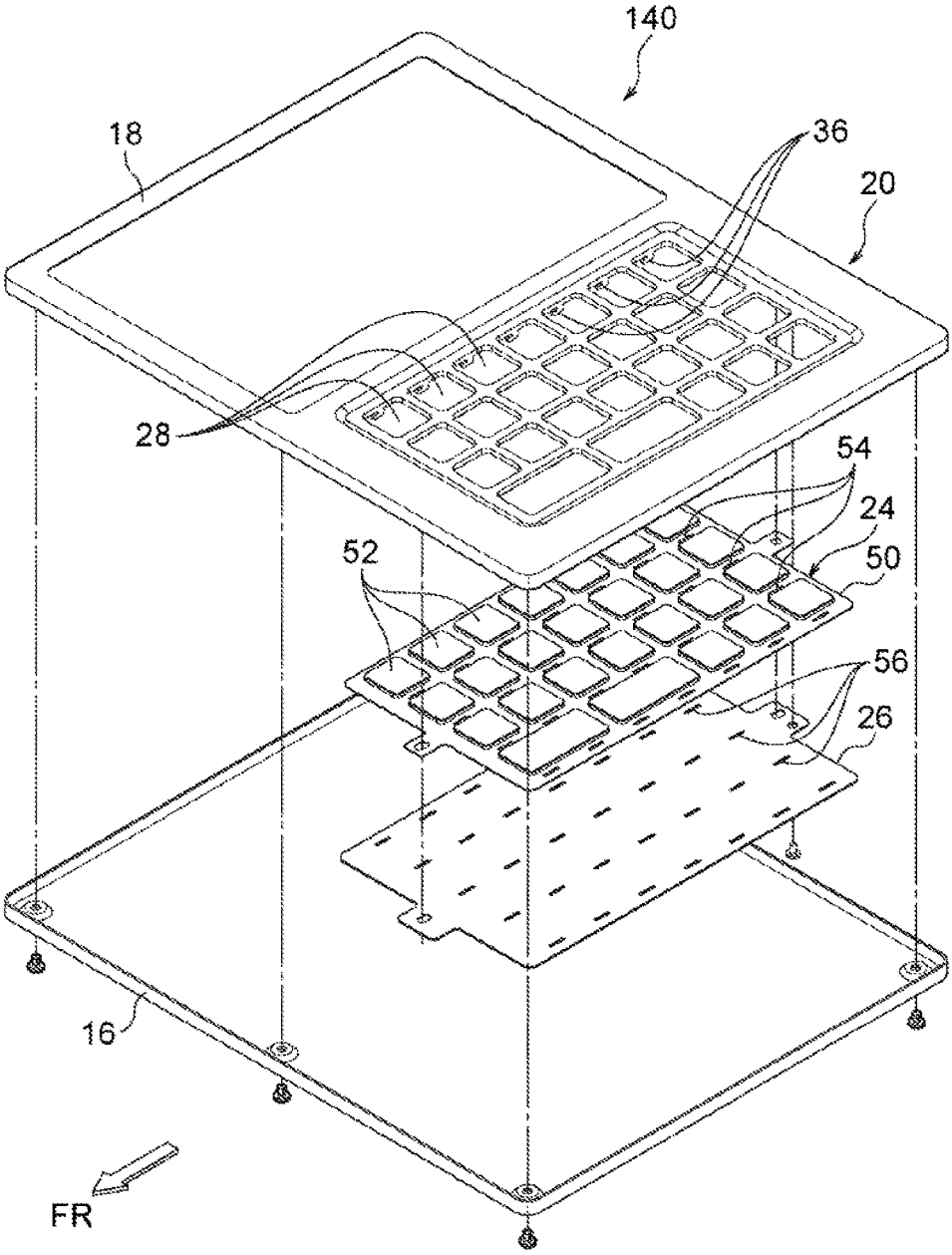
FIG. 17 is an exploded perspective view of the electronic equipment according to the first modification.

For instance, when the input device 20 is applied to an equipment other than the main device of a notebook personal computer, the keyboard 24 may be formed longitudinally long with a longitudinal direction in the depth direction and a transverse direction in the breadth direction like an electronic equipment 140 illustrated in FIG. 16, FIG. 17. For instance, in this case, the keyboard 24 may have rectangular key tops with a longitudinal direction in the longitudinal direction of the keyboard 24.

Figure 18:
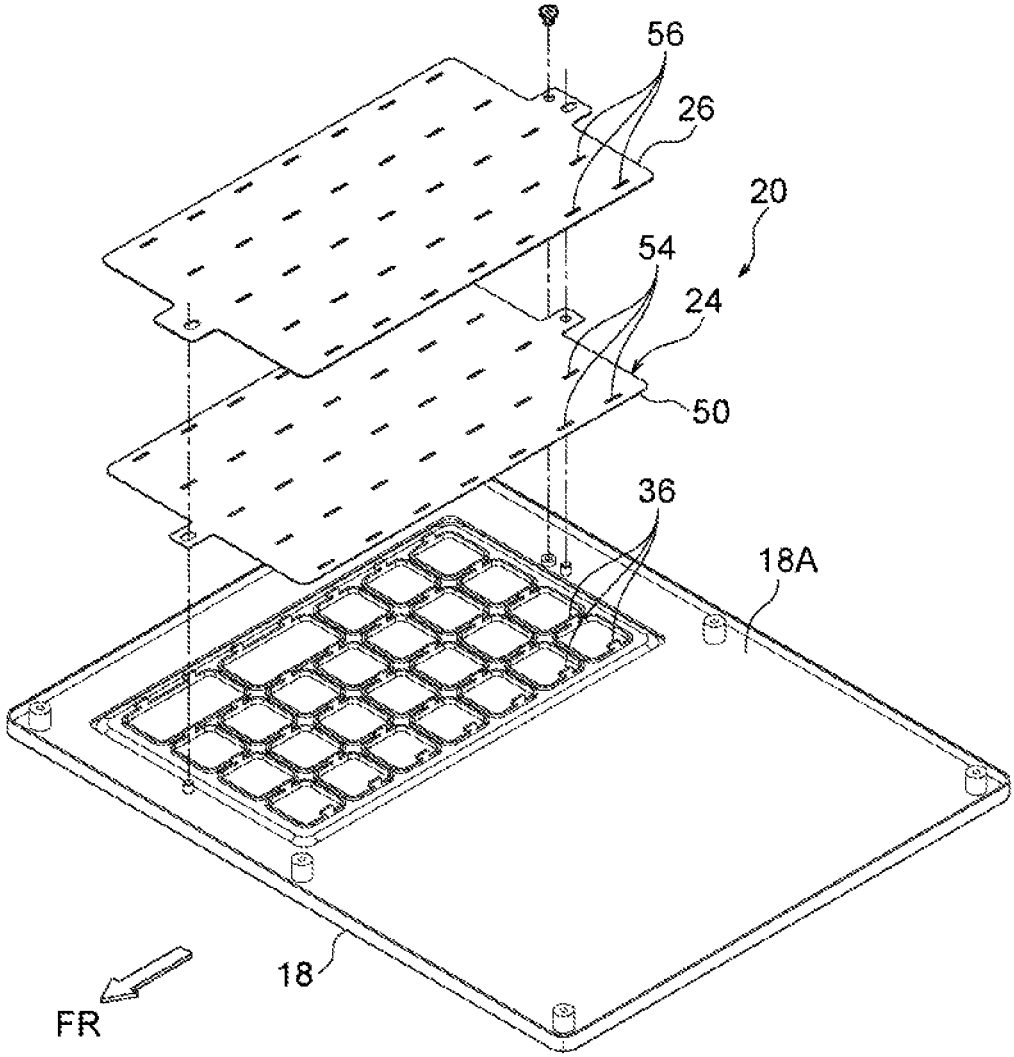
FIG. 18 is an exploded perspective view of the electronic equipment according to the first modification.

For instance, when the keyboard 24 is formed longitudinally long with a longitudinal direction in the depth direction and a transverse direction in the breadth direction, the hooks 36 may be formed facing in the depth direction of the keyboard 24 as illustrated in FIG. 18. Also, the first through holes 54 and the second through holes 56 may be formed as long holes extending in the depth direction of the keyboard 24. The support plate 26 may be slidable in the depth direction of the keyboard 24.

Figure 19:
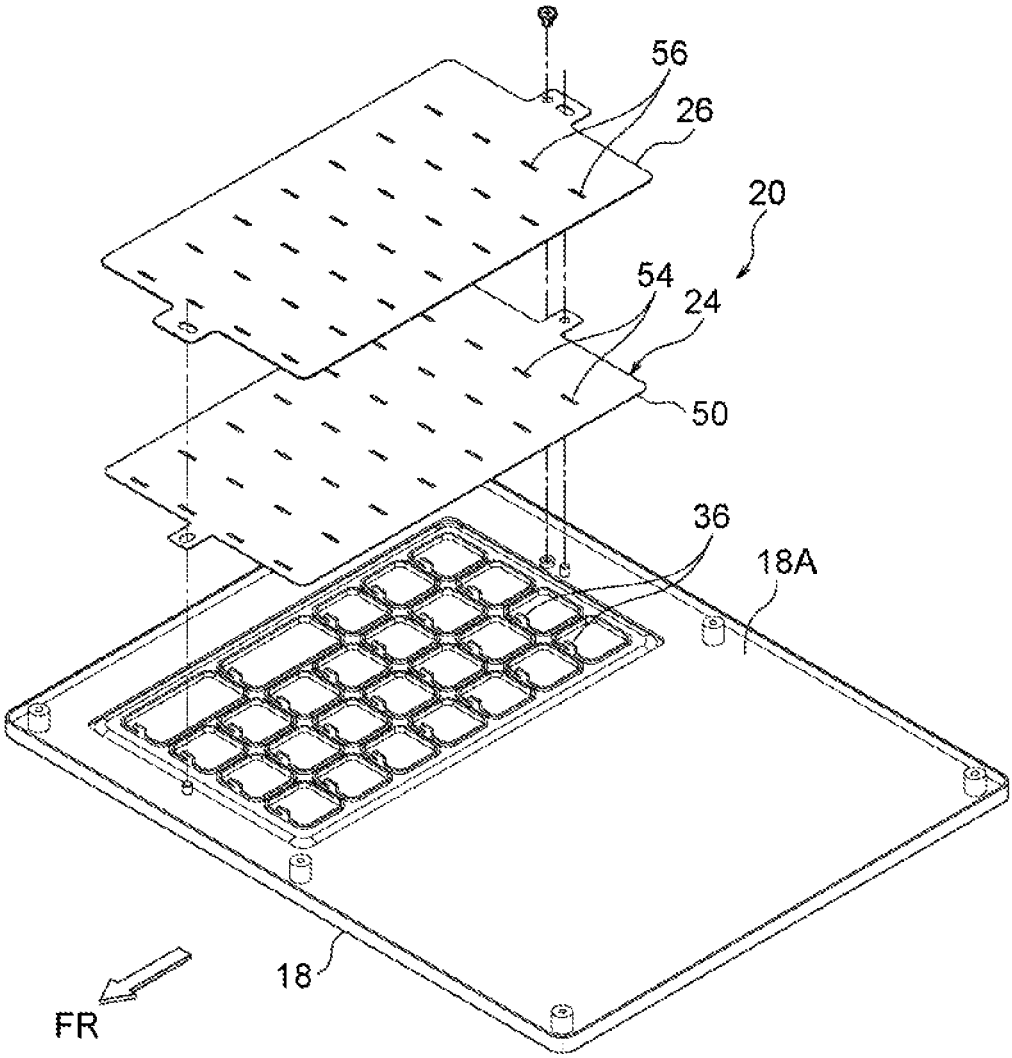
FIG. 19 is an exploded perspective view of an electronic equipment according to a second modification.

Although the support plate 26 is preferably slidable in the longitudinal direction of the keyboard 24, the support plate 26 may be slidable in the transverse direction of the keyboard 24 as in a second modification illustrated in FIG. 19.

In the first embodiment described above, the leading ends 46 of the hooks 36 extend to the right side (the RH arrow side) of the keyboard 24. When the support plate 26 is slid to the right side (the RH arrow side) of the keyboard 24, engagement of the support plate 26 with the leading ends 46 of the hooks 36 is released, and when the support plate 26 is slid to the left side (the opposite side to the RH arrow side) of the keyboard 24, the support plate 26 is engaged with the leading ends 46 of the hooks 36.

However, the leading ends 46 of the hooks 36 may extend toward the left side of the keyboard 24. When the support plate 26 is slid to the left side of the keyboard 24, engagement of the support plate 26 with the leading ends 46 of the hooks 36 may be released, and when the support plate 26 is slid to the right side of the keyboard 24, the support plate 26 may be engaged with the leading ends 46 of the hooks 36.

Also, the second through holes 56 are formed in the support plate 26, and the hooks 36 are inserted in the second through holes 56 to be engaged with the support plate 26. However, for instance, a plurality of engaged portions in a shape other than a through hole may be formed in the support plate 26, and the engaged portions may be engaged with the respective hooks 36.

In the first embodiment described above, in the hooks 36, more preferably, a plurality of hook sequences 48, in each of which multiple hooks 36 are arranged in the longitudinal direction of the keyboard 24, is arranged in the transverse direction of the keyboard 24. However, the hooks 36 may be arranged, for instance, in a staggered or random manner other than what has been described above.

Also, in the first embodiment described above, the positioning pin 58 is formed in the upper cover 18, and the positioning hole 68 in which the positioning pin 58 is inserted is formed in the base plate 50 of the keyboard 24. However, a positioning hole may be formed in the upper cover 18, and a positioning pin may be formed in the base plate 50.

In the first embodiment described above, the mounting member 22 is preferably fixed to the back surface 18A of the upper cover 18 by bonding or welding or the like. However, the mounting member 22 may be fixed to the back surface 18A of the upper cover 18 by a method other than bonding or welding, for instance, screwing.

[Second Embodiment]

Next, a second embodiment of the technique disclosed in the present application will be described.

Figure 9:
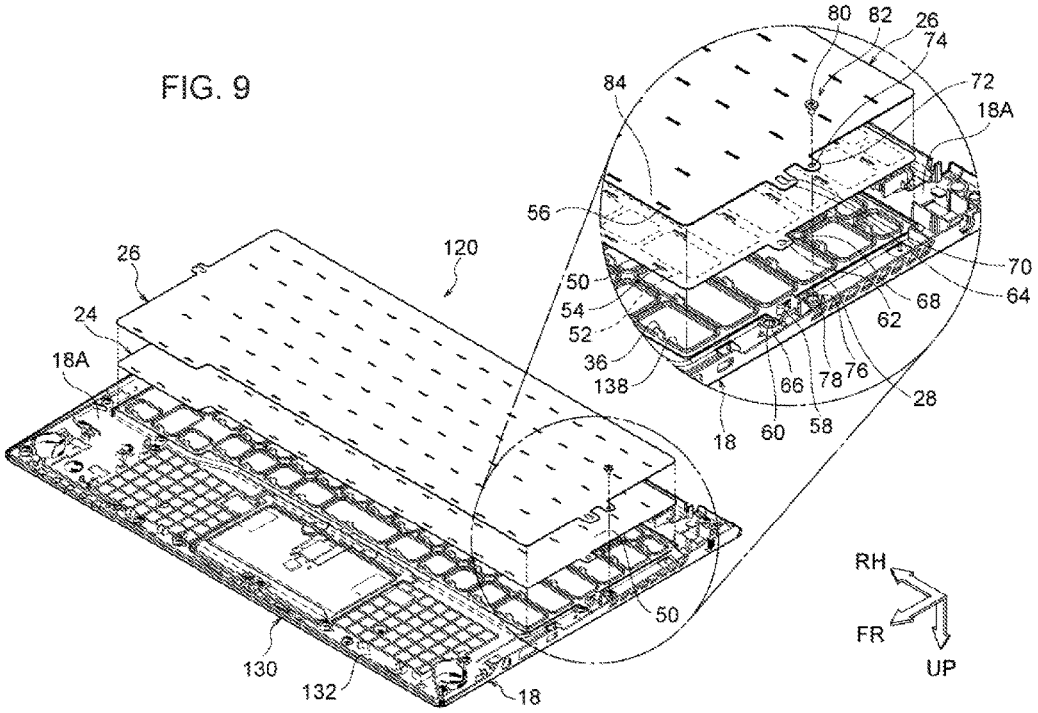
FIG. 9 is an exploded perspective view of an input device in a second embodiment as seen from the back side.
Figure 10:
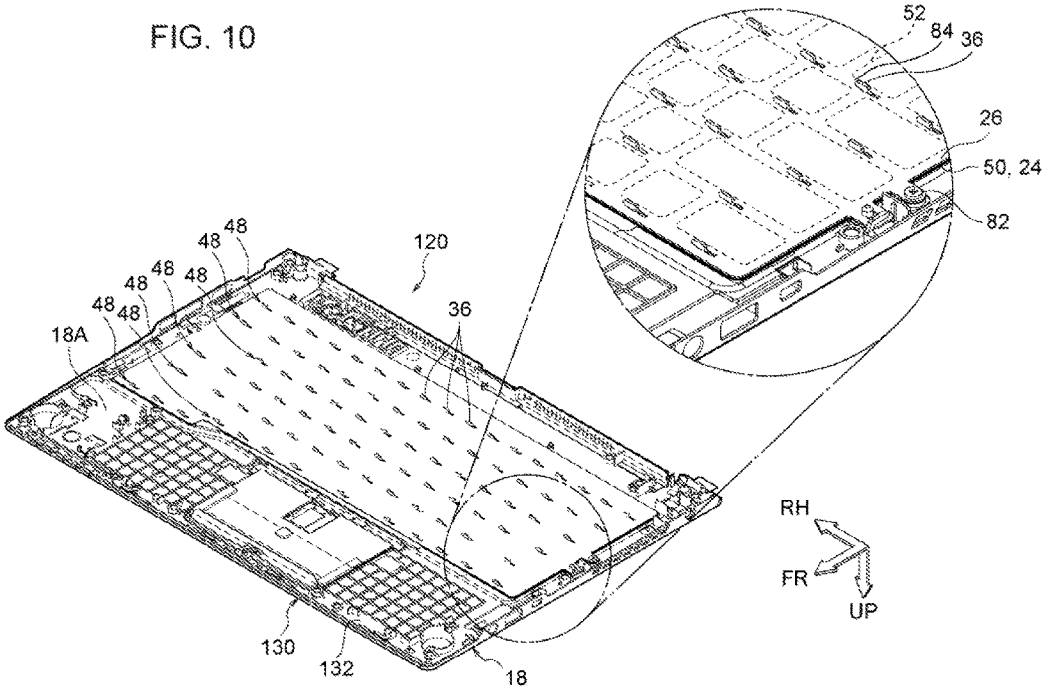
FIG. 10 is a perspective view illustrating a state of the input device in the second embodiment after being assembled.

FIG. 9 illustrates an exploded perspective view of an input device 120 according the second embodiment, and FIG. 10 illustrates a state the input device 120 according the second embodiment after being assembled. The structure of the input device 120 according to the second embodiment illustrated in FIG. 9, FIG. 10 has been modified on the input device 20 (see FIG. 3, FIG. 4) according to the first embodiment described above in the following manner.

Figure 11:
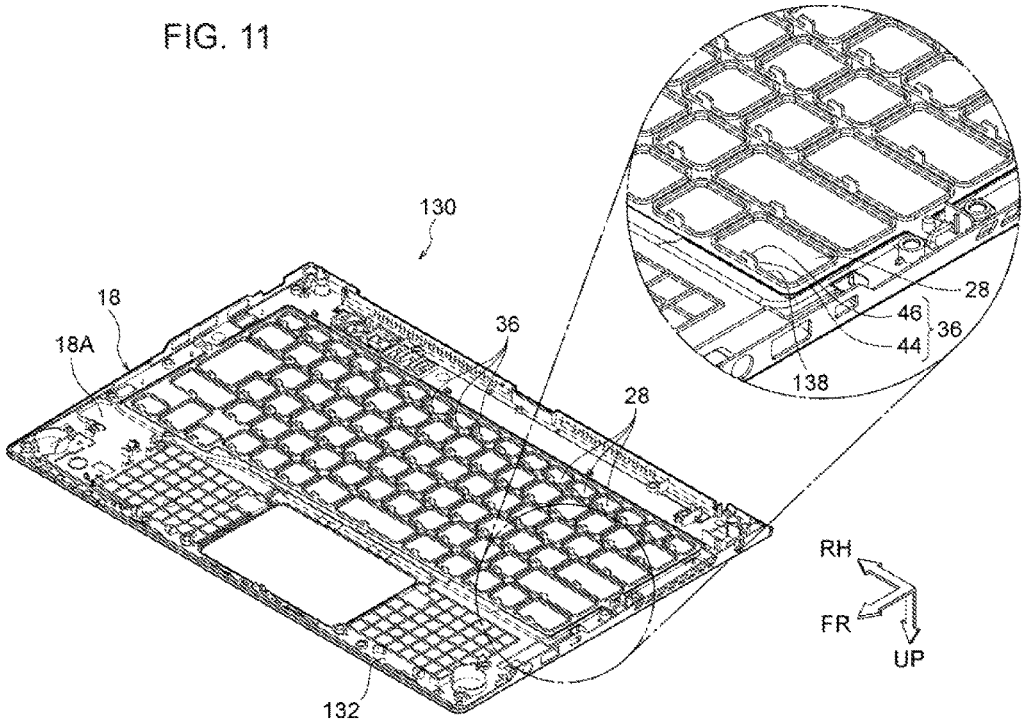
FIG. 11 is a perspective view of an upper cover structure in the second embodiment as seen from the back side.

That is, the input device 120 according to the second embodiment has an upper cover structure 130 instead of the upper cover structure 30 in the first embodiment described above. FIG. 11 illustrates the upper cover structure 130 in the second embodiment.

As illustrated in FIG. 11, the upper cover structure 130 has an upper cover 18 and a functional member 132. The functional member 132 is, for instance, made of resin, and is provided in the back surface 18A of the upper cover 18. In the functional member 132, various fixing sections and positioning sections are formed.

Similarly to the first embodiment, the upper cover 18 has the plurality of key openings 28. In addition, in the second embodiment, a plurality of hooks 36 and a plurality of standing wall sections 138 are integrally formed with the upper cover 18. The standing wall sections 138 are formed in the back surface 18A of the upper cover 18, and are each formed annularly along the peripheral edge of a corresponding one of the key openings 28. The hooks 36 have the same shape as the hooks 36 in the first embodiment, and are each formed on the top portion of a corresponding one of the standing wall sections 138.

Figure 12:
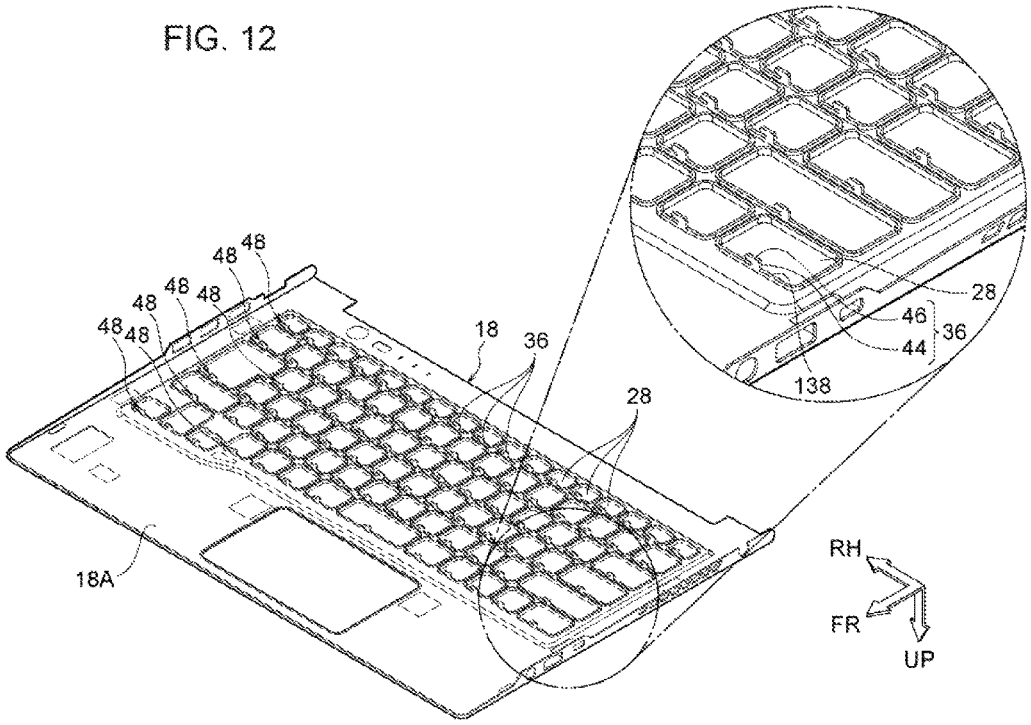
FIG. 12 is a perspective view of the upper cover in the second embodiment as seen from the back side.
Figure 13:
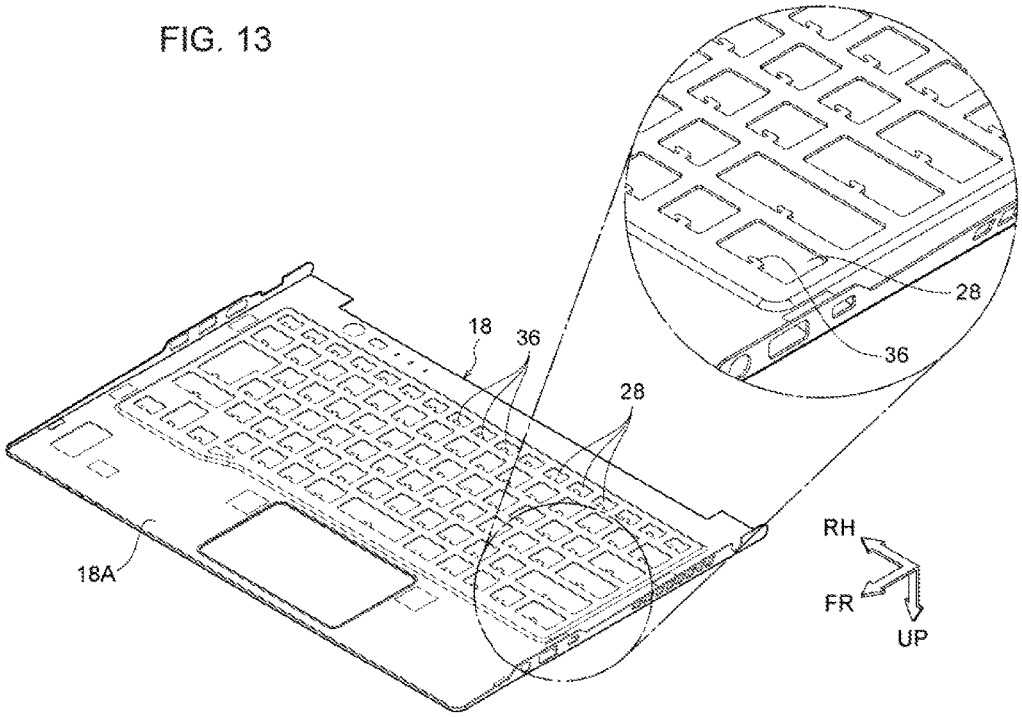
FIG. 13 is a perspective view illustrating a state of the upper cover in the second embodiment before being press-drawn.

FIGS. 12 and 13 illustrate the upper cover 18 in the second embodiment as a single body. In the second embodiment, the upper cover 18 is made of metal as an example, and is formed by punching and press drawing. FIG. 12 illustrates a state of the upper cover 18 in the second embodiment after being punched then press-drawn, and FIG. 13 illustrates a state of the upper cover 18 in the second embodiment after being punched and before being press-drawn.

As illustrated in FIG. 13, in the upper cover 18 in the second embodiment, the key openings 28, the hooks 36, and the standing wall sections 138 are formed by punching. The hooks 36, before a state of being press-drawn, are in a state of lying in the depth direction of the upper cover 18. As illustrated in FIG. 12, the hooks 36 and the standing wall sections 138 are formed by press drawing. The hooks 36 and the standing wall sections 138 are press-drawn, and thus are provided upright on the back side of the upper cover 18.

Similarly to the first embodiment, each hook 36 is formed in a substantially L-character shape having a base 44 extending to the back side of the upper cover 18, and a leading end 46 extending from the leading end of the base 44 to one side (the RH arrow side) of the upper cover 18 in the breadth direction.

Similarly to the first embodiment, the hooks 36 form a plurality of hook sequences 48. Each of the hook sequences 48 is linearly formed by multiple hooks 36 that are arranged in the breadth direction of the upper cover 18. The hook sequences 48 are arranged in the depth direction of the upper cover 18.

Next, the structure of the input device 120 along with a method of manufacturing (a method of assembling) the input device 120 according to the second embodiment will be described in detail.

As illustrated in FIG. 12, in the second embodiment, upper cover 18 is formed by punching and press drawing. The hooks 36 are formed by press drawing of the upper cover 18 as described above, and are provided upright on the back surface 18A of the upper cover 18. Subsequently, as illustrated in FIG. 9, the functional member 132 is assembled to the upper cover 18. The functional member 132 may be manufactured by resin molding and assembled to the upper cover 18, or may be integrated with the upper cover 18 by integral molding.

The base plate 50 of the keyboard 24 is then stacked on the upper cover 18 from the back, side of the upper cover 18, and the base plate 50 is disposed on the back side of the upper cover 18. When the base plate 50 is disposed on the back side of the upper cover 18, the key tops 52 are inserted in, the corresponding key openings 2, are exposed to the front side of the upper cover 18.

Also, in a state where the keyboard 24 is assembled to the upper cover 18 as described above, the hooks 36 are disposed in the respective key tops 52. The positional relationship between the hooks 36 and the key tops 52 is the same as in the first embodiment.

Also, when the base plate 50 is disposed on the back side of the upper cover 18 as described above, the positioning pin 58 is inserted in the positioning hole 68 formed in the second positioning piece 62 of the base plate 50, and the base plate 50 is positioned with respect to the upper cover 18. In addition, the hooks 36 are inserted in the corresponding first through holes 54 formed in the base plate 50, and the hooks 36 penetrate through the base plate 50.

Subsequently, the support plate 26 is stacked on the back surface of the base plate 50. When the support plate 26 is stacked on the back surface of the base plate 50, the positioning pin 58 is inserted in the positioning hole 70 formed in the third positioning piece 64 of the support plate 26. In addition, the hooks 36 through the base plate 50 are inserted in the corresponding second through holes 56 formed in the support plate 26.

At this point, since the positioning hole 70 formed in the support plate 26 is a long hole extending in the longitudinal direction of the support plate 26, the support plate 26 is slidable in the longitudinal direction of the keyboard 24 in a range of relative movement of the positioning pin 58 within the positioning hole 70.

As illustrated in FIGS. 9 and 10, the support plate 26 is slid in the direction opposite to the extending direction of the leading ends 46 of the hooks 36 (in other words, to the other side of the keyboard 24 in the longitudinal direction, and to the opposite side to the RH arrow). When the support plate 26 is slid to the other side of the keyboard 24 in the longitudinal direction in this manner, the leading ends 46 of the hooks 36 are each engaged with the peripheral portion (the engaged portion 84) of a corresponding second through hole 56 in the back surface of the support plate 26.

Figure 14:
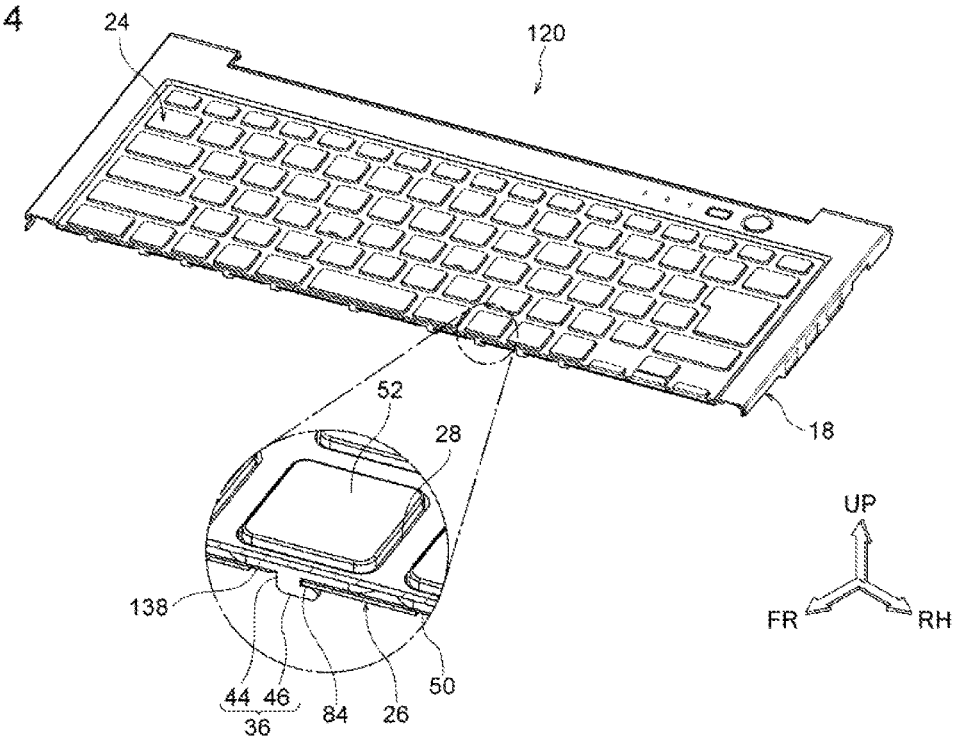
FIG. 14 is a perspective view including a partial section of the input device in the second embodiment.
Figure 15:
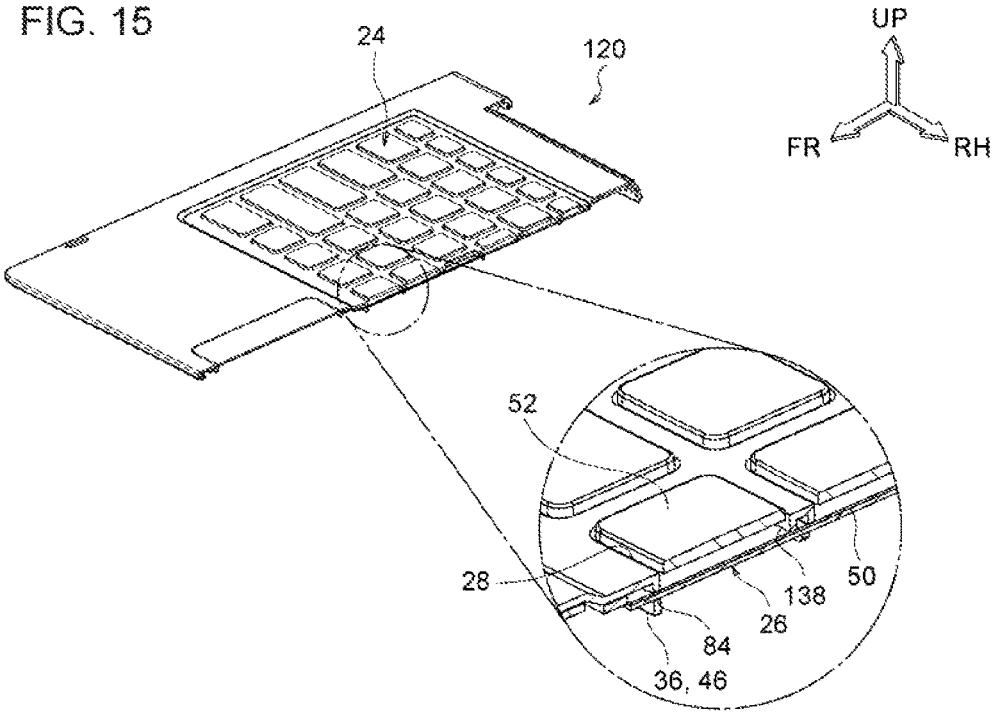
FIG. 15 is a perspective view including a partial section of the input device in the second embodiment.

Here, FIG. 14, FIG. 15 illustrate a perspective view of the input device 120 according to the second embodiment including a partial section. As illustrated in FIG. 14, FIG. 15, in a state where the leading ends 46 of the hooks 36 are each engaged with the peripheral portion (the engaged portion 84) of a corresponding second through hole 56 in the back surface of the support plate 26, the top portions (the ends on the base plate 50 side) of the standing wall sections 138 are in contact with the surface of the base plate 50.

The screw 80 is then inserted in the fixing hole 74 formed in the fixing piece 72 of the support plate 26 illustrated in FIG. 9 and the leading end 46 of the screw 80 is threaded into the screw hole 78 formed in the boss section 76 of the upper cover 18, and the support plate 26 is fixed to the upper cover 18. The input device 120 is manufactured in the above manner.

It is to be noted that similarly to the first embodiment, it is possible to disassemble the input device 120 by a procedure reverse to the above procedure. That is, when the screw 80 is removed, the support plate 26 is slidable in the longitudinal direction of the keyboard 24. When the support plate 26 is slid to one side (the RH arrow side) of the keyboard 24 in the longitudinal direction, engagement between the leading ends 46 of the hooks 36 and the support plate 26 (the engaged portion 84) is released, which allows disassembling of the input device 120.

Next, the operation and effect of the second embodiment will be described.

As described in detail above, in the input device 120 according to the second embodiment, the keyboard 24 is also assembled to the upper cover 18 from the back side of the upper cover 18. Also, the key openings 28 corresponding to the key tops 52 are formed in the upper cover 18, and the key tops 52 provided in the keyboard 24 are inserted in the corresponding key openings 28 from the back side of the upper cover 18, and are exposed to the front side of the upper cover 18. Therefore, for instance, as in the case where the keyboard 24 is assembled from the front side of the upper cover 18, it is possible to avoid formation of a joint with the outside shape of the keyboard 24 in the upper cover 18. Thus, it is possible to improve the design quality of the input device 120 (the main device 11).

Also, the hooks 36 disposed in the respective key tops 52 are provided upright on the back surface 18A of the upper cover 18, and the keyboard 24 is fixed to the upper cover 18 by the hooks 36. Therefore, it is possible to secure the rigidity of the peripheral portion of each key top 52 in the keyboard 24 by the hooks 36 disposed in the respective key tops 52. Consequently, it is possible to reduce depression of each key top 52 when pressed, and thus the perceived quality of the input device 120 may be improved.

Also, when the input device 120 is assembled, it is sufficient to slide the support plate 26 to the other side of the keyboard 24 in the longitudinal direction to engage the leading ends 46 of the hooks 36 with the support plate 26 and to tighten the screw 80 for fixing the support plate 26 to the upper cover 18. Therefore, for instance, in contrast to a structure in which the keyboard 24 is screwed to the upper cover 18 by a large number of screws, a large number of screws are unnecessary, thereby making it possible to decrease the man-hours for assembly and disassembly of the input device 120.

In the input device 120 according to the second embodiment, the hooks 36 are integrally formed with the upper cover 18. Therefore, it is possible to reduce the number of components and the man-hours for assembly, and thus low cost may be achieved.

Also, in the upper cover 18, the respective standing wall sections 138 are formed in the peripheral edges of the key openings 28. Therefore, since the standing wall sections 138 serve as ribs, it is possible to improve the rigidity of the upper cover 18.

Also, the top portions (the ends on the base plate 50 side) of the standing wall sections 138 are in contact with the surface of the base plate 50 of the keyboard 24. Therefore, it is possible to improve the rigidity of the peripheral portions of the key tops 52 in the keyboard 24 by the standing wall sections 138. Consequently, it is possible to further effectively reduce depression of each key top 52 when pressed.

With the input device 120 according to the second embodiment, the same structure as in the above-described first embodiment other than what has been described above allows the same operational effect as in the first embodiment to be achieved.

Also, in the second embodiment, the same modifications as those of the first embodiment described above may be adopted.

Although the first and second embodiments of the technique disclosed in the present application have been described in the above, the technique disclosed in the present application is not limited to what has been described above, and it goes without saying that various modifications may be made and practiced within the scope not departing from the spirit of the present application.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An input device comprising:

an upper cover including a plurality of key openings;

a mounting member including a frame portion disposed on a back surface of the upper cover and having a plurality of matching holes, each of which matching a corresponding one of the key openings, a keyboard including a base plate disposed on a back side of the mounting member and a plurality of key tops provided in a front side of the base plate and inserted in the respective key openings; and a plurality of hooks disposed upright at respective edges of the matching holes, each of the hooks being disposed between the key tops adjacent to each other at a plurality of points and fixing the keyboard to the upper cover.

2. The input device according to claim 1, wherein the hooks are through the base plate, a support plate is disposed on a back surface of the base plate, and leading ends of the hooks are engaged with the support plate.

3. The input device according to claim 2, wherein the keyboard is formed in a shape having a longitudinal direction and a transverse direction in a plan view, the support plate is slidable in the longitudinal direction of the keyboard, and the support plate is provided with an engaged portion that, in a state where the support plate is slid to one side of the keyboard in the longitudinal direction, releases engagement of the support plate with the leading ends of the hooks, and that, in a state where the support plate is slid to the other side of the keyboard in the longitudinal direction, engages with the leading ends of the hooks.

4. The input device according to claim 3, wherein in the hooks, a plurality of hook sequences, in each of which the hooks are arranged in the longitudinal direction of the keyboard and in correspondence to the respective key tops, is formed in the transverse direction of the keyboard.

5. The input device according to claim 1, wherein the key tops include a rectangular key top shape in a plan view, and each of the hooks is disposed at a central portion of one side of the rectangular key top shape.

6. The input device according to claim 5, wherein the keyboard is formed in a shape having a longitudinal direction and a transverse direction in a plan view, and one side of the rectangular key top shape is parallel to the longitudinal direction of the keyboard.

7. The input device according to claim 1, wherein a positioning pin is formed in one of the upper cover and the base plate, and a positioning hole, in which the positioning pin is inserted, is formed in the other of the upper cover and the base plate.

8. The input device according to claim 1, further comprising a fixing section that fixes the support plate to the upper cover.

9. An input device comprising:

an upper cover including a plurality of key openings;

a plurality of annular standing wall sections formed in a back surface of the upper cover, each of which is along a peripheral edge of a corresponding one of the key openings;

a keyboard including a base plate disposed on a back side of the upper cover, and a plurality of key tops provided in a front side of the base plate and inserted in the respective key openings, wherein top portions of the standing wall sections are in contact with a surface of the base plate; and a plurality of hooks disposed upright on the back surface of the upper cover, each of the hooks being disposed between the key tops adjacent to each other at a plurality of points and fixing the keyboard to the upper cover.

10. The input device according to claim 9, wherein the hooks are formed in the top portions of the standing wall sections.

11. An electronic equipment comprising:

a main device including an input device; and a display device rotatably fixed to the main device, wherein the input device includes an upper cover having a plurality of key openings, a mounting member including a frame portion disposed on a back surface of the upper cover and having a plurality of matching holes, each of which matching a corresponding one of the key openings, a keyboard having a plurality of key tops, each of which is inserted in a corresponding one of the key openings, and a plurality of hooks disposed upright at respective edges of the matching holes, each of the hooks being disposed between the key tops adjacent to each other at a plurality of points and fixing the keyboard to the upper cover.

12. A method of manufacturing an input device, the method comprising:

inserting each of a plurality of key tops provided in a keyboard into a corresponding one of a plurality of key openings from a back side of an upper cover having the key openings, through a corresponding matching hole of a plurality of matching holes of a mounting member disposed on a back surface of the upper cover; and fixing the keyboard to the upper cover by a plurality of hooks, each of which is disposed between the key tops adjacent to each other at a plurality of points, and is provided upright at respective edges of the matching holes.

13. The method of manufacturing an input device according to claim 12, comprising:

disposing a base plate of the keyboard in the back side of the upper cover, inserting each of the key tops provided in a front side of the base plate into a corresponding one of the key openings through the corresponding matching hole, and causing the hooks to penetrate through the base plate; and engaging leading ends of the hooks with a support plate which is stacked on a back surface of the base plate and fixing the keyboard to the upper cover.

* * * * *